US010759205B2

(12) United States Patent
Forget et al.

(10) Patent No.: US 10,759,205 B2
(45) Date of Patent: Sep. 1, 2020

(54) PRINTED DECORATIVE SURFACE COVERINGS

(71) Applicant: Tarkett GDL S.A., Lentzweiler (LU)

(72) Inventors: Luc Forget, Wiltz (LU); Igor Brankov, Wiltz (LU); Klass Kackmann-Schneider, Wiltz (LU)

(73) Assignee: Tarkett GDL S.A., Lentzweiler (LU)

( * ) Notice: Subject to any disclaimer, the term of this patent is extended or adjusted under 35 U.S.C. 154(b) by 53 days.

(21) Appl. No.: 15/558,268

(22) PCT Filed: Mar. 14, 2016

(86) PCT No.: PCT/EP2016/055410
§ 371 (c)(1),
(2) Date: Sep. 14, 2017

(87) PCT Pub. No.: WO2016/146565
PCT Pub. Date: Sep. 22, 2016

(65) Prior Publication Data

US 2018/0099519 A1 Apr. 12, 2018

(30) Foreign Application Priority Data

Mar. 16, 2015 (EP) ..... 15159282

(51) Int. Cl.
*B41M 5/00* (2006.01)
*B41M 5/52* (2006.01)

(52) U.S. Cl.
CPC ..... *B41M 5/0017* (2013.01); *B41M 5/0011* (2013.01); *B41M 5/0064* (2013.01); *B41M 5/0047* (2013.01); *B41M 5/5218* (2013.01); *B41M 5/5254* (2013.01)

(58) Field of Classification Search
None
See application file for complete search history.

(56) References Cited

U.S. PATENT DOCUMENTS

| | | | | | |
|---|---|---|---|---|---|
| 5,162,141 | A * | 11/1992 | Davey | B41M 1/30 | 428/542.2 |
| 5,916,392 | A * | 6/1999 | Ghanbari | C04B 28/04 | 156/280 |
| 2006/0252872 | A1* | 11/2006 | Jonckheree | B41M 5/52 | 524/493 |
| 2014/0144583 | A1 | 5/2014 | Hakansson et al. | | |

FOREIGN PATENT DOCUMENTS

| | | | | |
|---|---|---|---|---|
| EP | 1481811 | A1 * | 12/2004 | B41M 5/52 |
| EP | 1481811 | A1 | 12/2004 | |
| JP | H02 160857 | A | 6/1990 | |
| JP | H11 1656 | A | 1/1999 | |
| JP | 2007 154433 | A | 6/2007 | |
| KR | 2010 0097476 | A | 9/2010 | |
| WO | WO 98/55328 | A1 | 12/1998 | |

OTHER PUBLICATIONS

Anonymous; Inkjet printing—Wikipedia, the free encyclopedia, Feb. 27, 2015, XP055271123, Retrieved from the Internet, the paragraph about "Drop-on-demand".

* cited by examiner

*Primary Examiner* — Sheeba Ahmed
(74) *Attorney, Agent, or Firm* — Reinhart Boerner Van Deuren P.C.

(57) ABSTRACT

The present invention relates to a primer layer to improve the printability of floor or wall covering by aqueous ink compositions, the primer layer comprising one or more acrylic copolymers and silica and the covering comprising polyvinyl chloride.

26 Claims, No Drawings

PRINTED DECORATIVE SURFACE COVERINGS

FIELD OF THE INVENTION

The present invention relates to decorative floor and wall coverings comprising a printed-on thermoplastic material. The invention further relates to a method for the production of such surface coverings.

STATE OF THE ART

In recent years, printed building panels have gained increasing success. These types of decorative floor and wall panels usually comprise a thermoplastic substrate and a protective layer. The thermoplastic material is often polyvinyl chloride. The substrate is printed with a pattern resembling natural stone, wood, ceramics etc. The pattern is often printed by rotogravure printing or direct printing. However, rotogravure printing or direct printing does not offer the desired flexibility in changing design of the patterns and adapting patterns for different needs of clients. Furthermore, a certain repetition of the pattern cannot be avoided by rotogravure printing or direct printing.

Recently digital printing has offered new possibilities to the flooring industry to customize decorative patterns for floor and wall applications and to print small quantities of substrates. By digital printing is conventionally meant printing by means of non-contact printing, for example using a Drop-on-Demand (DOD) technique. A drop of ink is placed with great accuracy on a surface. Examples of DOD techniques are piezoelectric DOD inkjet and thermal DOD inkjet. In a piezoelectric DOD inkjet printer, the piezoelectric material changes shape when a voltage is applied. The change of shape of the piezoelectric material generates a pressure pulse in the fluid, thereby ejecting a droplet of ink from the nozzle. In a thermal DOD inkjet printer, ink drops are ejected by forming an ink vapor bubble by heating the ink.

Digital printers use one of two methods to print: single-pass and multi-pass. In the first case, the surface to be printed is fed in a single pass over four print heads, representing the four primary colors (cyan, magenta, yellow and black), which results in faster printing. In multi-pass, the same surface travels a longer path since it goes through four successive passes (one per color). Multi-pass reduces the cost of the printer since there's only one drum for all the primary colors, whereas with single-pass, there has to be one drum per primary color, but of course printing times are at least four times as long.

Single-pass digital printing has become quite advanced over the last few years and have emerged to challenge conventional technologies in many sectors.

Different kind of inks may be used for digital printing, such as UV curable inks, solvent based inks and aqueous inks (also called waterborne or water based inks). When printing on a thermoplastic substrates such as a substrate adapted to from decorative surface coverings, printing is facilitated by using UV curable inks or solvent based inks compared to aqueous inks. Printing with an aqueous ink on a thermoplastic substrate has proved to be difficult. A drop of an aqueous ink does not stay but tends to bleed on the thermoplastic surface, resulting in a print of low quality. However, due to environmental reasons, it is favorable to replace UV curable inks and solvent based inks.

The single-pass DOD representing huge time savings when compared to multi-pass DOD and other printing technologies, is more sensitive to bleeding, and images containing a multitude of white lines, distributed over the whole of the image, are obtained especially when aqueous inks are applied.

In order to provide an improved print on a thermoplastic material, obtained from digital printing of an aqueous pigment ink, US 2014/0144583 discloses an aqueous solution comprising a salt, preferably at least one metal salt, for being used as a primer before the digital printing step.

The metal salt may be a monovalent metal salt, for example comprising a monovalent ion such as Na. The metal salt may be a polyvalent metal salt. Preferably, the polyvalent metal salt comprises divalent ions such as $Ca^{2+}$, $Cu^{2+}$, $Ni^{2+}$, $Mg^{2+}$, $Zn^{2+}$, or $Ba^{2+}$, or trivalent ions such as $Al^{3+}$ or $Fe^{3+}$. The metal salt may for example be sodium chloride or calcium chloride. The salt may also be a non-metal salt such as ammonium chloride.

AIMS OF ASPECTS OF THE INVENTION

According to an aspect of the present invention it is aimed at providing a primer composition enabling the production of printed decorative floor and wall coverings comprising high quality images obtained by digital printing, more particularly single-pass digital printing, of aqueous pigment inks.

According to a second aspect of the present invention, it is aimed at providing printed decorative floor and wall coverings comprising such a primer.

According to a third aspect of the present invention it is aimed at providing a method for producing a printed decorative floor or wall coverings.

SUMMARY OF THE INVENTION

The present invention discloses a primer layer to improve the printability of floor or wall covering by aqueous ink compositions, the primer layer comprising one or more acrylic copolymers and silica and the covering comprising polyvinyl chloride.

Preferred embodiments of the present invention include one or more of the following features:

- the primer layer comprises from 15 to 35% by weight, preferably from 20 to 30% by weight of silica and from 40 to 80% by weight, preferably from 50 to 75% by weight, more preferably from 60 to 70% by weight of one or more acrylic copolymer;
- the silica is characterized by a d50 particle size, as determined by the laser light scattering granulometry technique, according to ISO 13320-1, comprised between 4.5 and 14 μm, preferably between 5.5 and 12 μm, more preferably between 6.5 and 10 μm;
- the silica is characterized by a BET specific surface according to ISO 9277 of at least 350 $m^2/g$, preferably at least 450 $m^2/g$, more preferably at least 550 $m^2/g$, most preferably at least 650 $m^2/g$.

The present invention further discloses a printed decorative surface covering comprising the primer layer wherein the thickness of the primer layer is comprised between 5 and 30 μm, preferably between 5 and 25 μm, more preferably between 5 and 20 μm.

The present invention also discloses a printed decorative surface covering comprising two or more assembled substrates, each of the substrates being coated with the primer layer, the primer layer being covered by a print layer.

The present invention further discloses a method for the preparation of the decorative surface covering, the method comprising the steps of:

providing a polyvinyl chloride substrate;

applying the primer layer;

printing, preferably by digital printing, a print on the primer layer with an aqueous pigment ink composition;

drying and/or curing the aqueous pigment ink composition to form the printed substrate.

Preferred embodiments of the method for the preparation of the decorative surface covering include one or more of the following features:

the primer layer is obtained from drying a primer composition comprising an acrylic copolymer dispersion, preferably an anionic acrylic copolymer dispersion comprising silica, the acrylic copolymer dispersion being characterized by a Minimum Film Forming Temperature, according to ASTM D2354, comprised between 10 and 60° C. and preferably between 15 and 50° C.;

an additional step of the method comprises contacting the printed substrate with a protecting layer the protecting layer comprising a thermoplastic material;

the protective layer is contacted with the printed substrate through a calendaring process or a coating process;

an additional step comprises contacting the protective layer with a topcoat layer the topcoat layer comprising a cross-linked material;

the topcoat layer is obtained from curing a radiation curable coating composition, the radiation curable composition comprising ethylenically unsaturated acrylic, ester, ether or urethane comprising polymers, oligomers or monomers;

the aqueous pigment ink composition is printed by a single-pass digital printer;

an additional step comprises performing mechanical embossing at a surface temperature comprised between 100° C. and 200° C.

DETAILED DESCRIPTION OF THE INVENTION

The present invention provides decorative floor and wall coverings comprising high quality prints, obtained from digital printing, in particular from single-pass digital printing, of aqueous pigment inks on thermoplastic substrates.

According to a first aspect of the present invention a primer formulation for application on thermoplastic substrates is provided, the primer formulation enabling high quality prints on the thermoplastic substrates. The primer formulation of the present invention comprises an acrylic copolymer dispersion and silica.

The copolymer dispersions for being used in the primer composition of the present invention may be obtained by copolymerization ethylenically unsaturated monomers in aqueous emulsion in the presence of non-ionic, cationic or anionic surfactants. Preferably the copolymer dispersions are anionic copolymer dispersions wherein the anionic surfactants are higher fatty alcohol sulfates such as for example sodium or potassium lauryl sulfate.

The acrylic copolymers of the acrylic copolymer dispersions in general comprise from 10 to 90% by weight, preferably from 20 to 80% by weight of (meth)acrylic acid esters, from 5 to 40% by weight, preferably from 10 to 30% by weight of ethylenically unsaturated mono- or diacids, from 0 to 50% by weight, preferably from 5 to 40% by weight of ethylenically unsaturated monomers other than (meth)acrylates and ethylenically unsaturated mono- or diacids.

Examples of (meth)acrylic acid esters that may be used for preparing the copolymers of the present invention are methyl, ethyl, propyl, isopropyl, butyl, isobutyl, tert-butyl, hexyl, 2-ethylhexyl, octyl, dodecyl, octadecyl, octenyl and stearyl (meth)acrylate.

Examples of ethylenically unsaturated mono- or diacids are (meth)acrylic acid, crotonic acid, maleic acid, fumaric acid, itaconic acid, citraconic acid, senecioic acid and the monoalkyl esters the diacids.

Examples of ethylenically unsaturated monomers other than (meth)acrylates that may be incorporated in the copolymers of the present invention are ethylene, propylene, butylene, isobutylene, vinyl chloride, vinylidene chloride, (meth)acrylonitrile, styrene, α-methyl styrene, vinyl formate, vinyl acetate, vinyl propionate, vinyl butyrate, vinyl isobutyrate, vinyl valerate, vinyl 2-ethylhexanoate, vinyl isooctanoate, vinyl nonoate, vinyl decanoate, vinyl pivalate, vinyl versatate, cetylvinyl ether, dodecylvinyl ether, di-butyl maleate, di-2-ethylhexyl maleate, acrylamide, methacrylamide, N(hydroxymethyl)-acrylamide, N-isopropyl acrylamide, vinylsulfonic acid, 2-acrylamido-2-methylpropanesulfonic acid, styrene-p-sulphonic acid and allylalcohol The acrylic copolymer optionally may comprise up to 3% by weight, based on the monomer mixture, of cross-linking monomers.

Examples of I cross-linking monomers are methylene-bis-acrylamides, methylene-bis-methacrylamides, diacrylates, polyacrylates, dimethacrylates and polymethacrylates of dihydric or polyhydric $C_2$-$C_6$-alcohols, divinyldioxane, diallyl phthalate, diallyl ethers or triallyl ethers of dihydric or polyhydric alcohols, especially of pentaerythritol, and diacrylates and dimethacrylates of polyethylene glycols and polypropylene glycols.

The copolymer dispersions preferably used in the primer formulation of the present invention are characterized by a solid content comprised between 20 and 65% by weight, preferably between 25 and 60% by weight, more preferably between 30 and 55% by weight and most preferably between 35 and 50% by weight.

The acrylic copolymer dispersions, used in the primer of the present invention, are characterized by a Minimum Film Forming Temperature, according to ASTM D2354, comprised between 10 and 60° C. and preferably between 15 and 50° C.

The Minimum Film Forming Temperature of the acrylic copolymer dispersion, according to ASTM D2354, is at most 20° C., preferably at most 15° C., more preferably at most 10° C., most preferably at most 5° C. higher than the casting temperature of the acrylic copolymer comprising film, as measured in an air ventilated oven.

Advantageously the casting temperature of the acrylic copolymer comprising film, as measured in an air ventilated oven, is at least 20° C., preferably at least 15° C., more preferably at least 10° C. and most preferably at least 5° C. higher than the Minimum Film Forming Temperature of the acrylic dispersion, according to ASTM D2354.

The primer formulation of the present invention comprises the acrylic copolymer dispersion in an amount comprised between 40 and 80% by weight, preferable between 50 and 75% by weight, more preferably between 60 and 70% by weight of the total weight of the primer formulation.

The silica for being used in the primer composition of the present invention is characterized by a particle size, d50, as determined by the laser light scattering granulometry technique, according to ISO 13320-1, comprised between 4.5 and 14 μm, preferably between 5.5 and 12 μm, more preferably between 6.5 and 10 μm.

The silica is further characterized by a BET specific surface (according to the Brunauer-Emmett-Teller Surface Area Analysis) according to ISO 9277 of at least 350 $m^2/g$, preferably at least 450 $m^2/g$, more preferably at least 550 $m^2/g$ or less, most preferably at least 650 $m^2/g$.

The silica further is characterized by a high porosity, measured as DOA absorption capacity. For highly porous particles, because of the small dimensions of the pores, liquids are drawn inside the pores by capillary forces. Due to this purely physical absorption process the absorption is independent of the chemical nature of the liquid to absorb. In general dioctyl adipate (DOA) is used.

The DOA absorption capacity of the silica is comprised between 200 and 300 ml, preferably between 220 and 290 ml, more preferably between 240 and 280 ml, most preferably between 250 and 270 ml per 100 g of silica.

The primer formulation comprises silica in an amount comprised between 2 and 20% by weight, preferably between 5 and 15% by weight of the total weight of the primer formulation.

The primer formulation of the present invention further comprises one or more dispersing additives in an amount comprised between 1 and 4% by weight, preferably between 1.5 and 3.5% by weight of the total weight of the primer formulation.

Examples of dispersing additives are the sodium salt of a naphthalenesulfonic acid-formaldehyde condensation product, e.g. 2,2'-dinaphthylmethane-6,6'-disulfonic acid, sodium salt; aliphatic amines and salts thereof, e.g. containing a long chain aliphatic group, e.g., hexadecyltrimethyl ammonium chloride; or alkylphenolpolyglycol ethers as e.g., nonylphenolpolyglycol ethers or isooctylphenolpolyglycol ether (e.g., p-nonylphenol or p-isooctylphenolethylene oxide adducts having 10 to 20 ethylene oxide units per molecule).

The primer formulation of the present invention further may comprise one or more antifoaming additives in an amount comprised between 0.2 and 2% by weight, preferably between 0.5 and 1.5% by weight of the total weight of the primer formulation.

Examples of antifoaming agents are polysiloxanes, such as polymethylhydrogensiloxane or polydimethylsiloxane, polyoxyalkylene polysiloxane block copolymers, grafted polyoxyalkylene polysiloxane block copolymers and mixtures thereof with organic oils such as mineral oils such as naphthenic and paraffinic mineral oil, polypropylene oxide, polybutadiene, certain oils of vegetable or animal origin, and the like.

To the primer formulation of the present invention, water may be added in order to reduce its final viscosity to a value comprised between 50 and 700 mPa·s, preferably between 100 and 600 Pa·s, more preferably between 200 and 500 mPa·s, as measured by a Brookfield viscometer at 25° C. (spindle 4 at 50 rpm).

The water quantity added, in general is comprised between 5 and 35% by weight, preferably between 10 and 30% by weight, more preferably between 15 and 25% by weight of the total weight of the primer formulation.

To the primer formulation further may comprise high boiling alcohols which are added in such an amount that they comprise less than 10% by weight, preferably 7% by weight, more preferably less than 5% by weight of the total weight of the primer composition. High boiling alcohols in general are added in order to manage the evaporation speed of the primer formulation upon application. Examples of high boiling alcohols are glycerol and sorbitol, The manner wherein the primer formulation is prepared or the order in which the constituents are mixed with each other is not significant. The important criterion is that mixing is thorough to form a homogeneous dispersion.

According to a second aspect of the present invention, printed decorative floor and wall coverings are provided comprising a substrate coated with a primer layer, the primer layer being covered by a print layer wherein the primer layer comprises one or more acrylic copolymers and silica.

The substrate comprises a thermoplastic material such as polyvinyl chloride, polyester, polypropylene, polyethylene, polystyrene, polyurethane, polyethylene terephthalate, polyacrylate, polyvinyl butyral, or a combination thereof. The substrate may further comprise additives such as a plasticizer. The substrate may be in form of a thermoplastic foil or film. The substrate may be transparent, colored or opaque. The color of the carrier may form a base color for the print.

The decorative surface of the present invention may comprise two or more assembled substrates, each of the substrates being coated with a primer layer and a print layer, wherein the primer and the print is provided either on the upper or on the lower surface of the two or more substrates.

Alternatively, the substrate layer comprises a primer layer and a print on both of its surfaces. Same pattern or design may be printed on both surfaces of the substrate. Alternatively, the print or design may be different.

The decorative floor and wall covering further comprises a protecting layer, the protecting layer comprising a thermoplastic material.

The protective layer may be a foil or film comprising a thermoplastic material such as polyvinyl chloride, polyester, polypropylene, polyethylene, polystyrene, polyurethane, polyethylene terephthalate, polyacrylate, polyvinyl butyral, or a combination thereof. The protective layer may further comprise additives such as a plasticizer.

The protective layer comprising thermoplastic material, is arranged on and bonded to the printed substrate.

In a preferred embodiment a topcoat layer comprising cross-linked material, preferably obtained from cross-linking radiation curable coating compositions, is arranged on a protective layer, comprising thermoplastic material, in order to improve the wear resistance and chemical resistance of the protective layer comprising thermoplastic material.

The topcoat layer may be a cross-linked layer such as a cross-linked coating preferably obtained from curing a radiation curable coating composition, the radiation curable composition comprising ethylenically unsaturated polyacrylate, polyester or polyurethane polymers and/or oligomers and optionally ethylenically unsaturated monomers. Wear resistant particles such as aluminium oxide particles may be included in the cross-linked topcoat layer. The cross-linked topcoat layer is preferably transparent. The topcoat layer comprising cross-linked material, is arranged on to the protective layer.

The decorative floor and wall coverings of the present invention may include a reinforced layer, comprising a carrier, such as a glass mat and/or non-woven and a thermoplastic material.

The decorative floor and wall coverings of the present invention may be provided with a baking layer.

The backing layer may comprise a thermoplastic material such as polyvinyl chloride, polyester, polypropylene, polyethylene, polystyrene, polyurethane, or polyethylene terephthalate. The baking layer may further comprise fillers, for example calcium carbonate, and additives such as plasticizer, impact modifier, stabilizer, processing aids, pigment, lubricants etc. Alternatively, the baking layer may be a Wood Plastic Composite comprising a thermoplastic binder and wood fibers or particles.

The primer layer, obtained from the primer composition of the present invention, comprises between 15 and 35% by weight, preferably between 20 and 30% by weight of silica, from 60 to 80% by weight, preferably from 65 to 75% by weight of acrylic copolymer and from 1 to 10% by weight, preferably from 2 to 8% by weight of dispersing and antifoaming additives.

The thickness of the primer layer is comprised between 5 and 30 μm, preferably between 5 and 25 μm, more preferably between 5 and 20 μm.

The ink comprises dyes and/or pigments giving the ink its specific color, optionally silica particulates and optionally one or more binders. Alternatively, the pigment may be coated by a binder. The binder preferably is a polymer such as for example styrene, (meth)acrylic (co)polymer, or unsaturated monomers, polyesters, vinyl (co)polymers, aromatic and aliphatic polyurethanes, or alkyd resins.

The print may be a decorative design. The decorative design may be natural designs and patterns such as a wood pattern or stone pattern. The decorative design may also be a fantasy design or pattern or a photograph.

According to a third aspect of the present invention a method for producing printed decorative floor and wall coverings is provided.

The method comprises:

providing a substrate;

applying a primer composition comprising at least one acrylic copolymer dispersion and silica salt on a surface of the substrate;

drying the primer formulation to form the primer layer;

printing, preferably by digital printing, a print on the primer layer with an aqueous pigment ink composition;

drying and/or curing the aqueous pigment ink composition formulation to form the printed substrate.

Prior to the application of the primer composition, the substrate may be pre-treated by corona, flaming or plasma.

The primer composition is applied on the substrate by any method for liquid coating application, known in the art, such as curtain coating, roller application or spray coating.

The step of drying the primer composition comprises applying heat to the primer composition. Heat may be applied in form of for instance medium and/or short infrared irradiation and/or heated air.

The aqueous pigment ink is printed by a digital printing process. The printer is preferably an inkjet printer. Preferably, the printer is a DOD (Drop on Demand) piezo-electric inkjet printer. In particular the printer is a single pass DOD (Drop on Demand) piezo-electric inkjet printer. A thermal DOD inkjet printer may also be used.

The step of drying- and/or curing the aqueous pigment ink composition comprises applying heat to the aqueous ink composition. Heat may be applied in form of for instance medium and/or short infrared irradiation and/or heated air.

After the primer has been dried, the primed substrate may be rolled on a roller for storage until printing.

Alternatively, after the print has been dried and/or cured, the printed substrate may be rolled on a roller for storage until further processing.

In an additional step, the method of the present invention comprises contacting a protective layer, comprising a thermoplastic material with the printed surface of the substrate.

The process for contacting a thermoplastic protecting layer with the printed substrate comprises a calendaring, a lamination or a co-extrusion process, among others.

In an additional step, the method of the present invention comprises contacting a topcoat layer, comprising a cross-linked material, with the protective layer.

The process for contacting a cross-linkable topcoat layer with the thermoplastic protection layer comprises any liquid coating application technique, known in the art, such as curtain coating, roller application or spray coating.

The primer of the present invention prevents the ink drops from accumulating and mixing into large ink drops so that a print of high quality, made by digital printing of an aqueous pigment ink composition, is obtained.

The primer and the print do not reduce the bonding strength between the printed substrate and the protective layer.

Furthermore, the print is not affected when contacting the printed substrate with the protective layer. The primer has already agglomerated the ink such that the ink drops are fixed on the substrate and not affected by the contacting with subsequent layers.

In an additional step the method of the present invention comprises pressing the substrate, having the print thereon and the protective layer with an embossed press plate. The embossing temperature is comprised between 100 and 200° C. A printed decorative surface having an embossed structure thus is formed.

Embossing preferably is performed before application and cross-linking of the topcoat layer, or after application and before cross-linking of the topcoat layer.

EXAMPLES

The following illustrative examples are merely meant to exemplify the present invention but is not destined to limit or otherwise define the scope of the present invention.

Example 1: Primer Composition 625.9 parts of Neocryl® XK 151, 39.0 parts of glycerol, 29.5 parts of Tego® Dispers 650, 11.0 parts of Tego® Foamex 842 and 184.1 parts of water were placed in a lab beaker provided with an electronic overhead lab mixer. Subsequently 110.5 parts of Sipernat® 310 were slowly added while stirring at 3000 rpm with a 6 cm diameter disc disperser. After completion of the silica addition the mixture is further stirred for 3 minutes until a homogeneous primer composition is obtained.

Example 2: Printed Substrate with Primer

A polyvinyl chloride substrate for decorative surface applications, was coated with the primer of example 1. After drying in an air ventilated oven at 80° C. for 6 seconds a primer layer with a coating thickness of 5 μm was obtained. The substrate, comprising the primer, was printed by means of a single pass digital printer with a water based ink. The print was dried during 3 seconds at 80° C. in an air ventilated oven. The printed substrate was bonded to a transparent protective polyvinyl chloride foil in a hot/cold-pressing step at 170° C. for 60 seconds at approximately 7 bar pressure, followed by cooling down to 25° C. at approximately 2 bar pressure. The printed image is fixated evenly over the surface of the substrate and a print result with good colour strength and resolution is achieved. The bonding between the printed substrate and the protective foil was good.

Comparative Example: Printed Substrate without Primer

A polyvinyl chloride foil for decorative surface applications, was printed directly on by means of a digital printer with a water based ink. The print was dried during 1 minute at 80° C. in an air ventilated oven. The printed foil was bonded to a transparent protective polyvinyl chloride foil in a hot/cold-pressing step at 170° C. for 60 seconds at approximately 7 bar pressure, followed by cooling down to 25° C. at approximately 2 bar pressure. The bonding between the printed PVC foil and the protective foil was good.
The resulting print is of poor quality. The ink drops have agglomerated to large ink drops. The ink drops have started to bleed into each other.

The invention claimed is:

1. A printed decorative surface covering, comprising:
a floor or wall covering comprising a polyvinyl chloride substrate coated with a primer layer, the polyvinyl chloride substrate coated with a primer layer carrying a print applied directly thereon, the primer layer improving the printability of the floor or wall covering by aqueous ink compositions, said primer layer comprising one or more acrylic copolymers and silica, wherein said primer layer comprises from 15 to 35% by weight, of silica and from 40 to 80% by weight, of one or more acrylic copolymer.

2. The printed decorative surface covering according to claim 1 wherein the silica is characterized by a d50 particle size as determined by the laser light scattering granulometry technique, according to ISO 13320-1, comprised between 4.5 and 14 μm.

3. The printed decorative surface covering according to claim 1 wherein the silica is characterized by a BET specific surface according to ISO 9277 of at least 350 m2/g.

4. The printed decorative surface covering according to claim 1, wherein the thickness of the primer layer is comprised between 5 and 30 μm.

5. The printed decorative surface covering according to claim 4, comprising two or more assembled substrates, each of said substrates being coated with the primer layer, said primer layer being covered by a print layer.

6. Method for the preparation of the decorative surface covering according to claim 1, comprising the steps of:
providing a polyvinyl chloride substrate;
applying the primer layer;
printing a print on said primer layer with an aqueous pigment ink composition;
drying and/or curing the aqueous pigment ink composition to form a printed substrate.

7. The method according to claim 6 wherein the primer layer is obtained from drying a primer composition comprising an acrylic copolymer dispersion, said acrylic copolymer dispersion being characterized by a Minimum Film Forming Temperature, according to ASTM D2354, comprised between 10 and 60° C.

8. The method according to claim 6 comprising the additional step of contacting the printed substrate with a protecting layer said protecting layer comprising a thermoplastic material.

9. The method according to claim 6 wherein the protective layer is contacted with the printed substrate through a calendaring process or a coating process.

10. The method according to claim 6 comprising the additional step of contacting the protective layer with a topcoat layer said topcoat layer comprising a cross-linked material.

11. The method according to claim 6, wherein the topcoat layer is obtained from curing a radiation curable coating composition, said radiation curable composition comprising ethylenically unsaturated acrylic, ester, ether or urethane comprising polymers, oligomers or monomers.

12. The method according to claim 6, wherein the aqueous pigment ink composition is printed by a single-pass digital printer.

13. The method according to claim 6, comprising the additional step of performing mechanical embossing at a surface temperature comprised between 100° C. and 200° C.

14. The printed decorative surface covering according to claim 1, wherein the primer layer comprises from 20 to 30% by weight of silica and from 50 to 75% by weight, of one or more acrylic copolymer.

15. The printed decorative surface covering claim 14, comprising from 60 to 70% by weight of one or more acrylic copolymer.

16. The printed decorative surface covering according to claim 1 wherein the silica is characterized by a d50 particle size as determined by the laser light scattering granulometry technique, according to ISO 13320-1, comprised between 5.5 and 12 μm.

17. The printed decorative surface covering according to claim 1 wherein the silica is characterized by a d50 particle size as determined by the laser light scattering granulometry technique, according to ISO 13320-1, between 6.5 and 10 μm.

18. The printed decorative surface covering according to claim 1 wherein the silica is characterized by a BET specific surface according to ISO 9277 of at least 450 m2/g.

19. The printed decorative surface covering according to claim 1 wherein the silica is characterized by a BET specific surface according to ISO 9277 of at least 550 m2/g.

20. The printed decorative surface covering according to claim 1 wherein the silica is characterized by a BET specific surface according to ISO 9277 of at least 650 m2/g.

21. The printed decorative surface covering according to claim 1, wherein the thickness of the primer layer is comprised between 5 and 25 μm.

22. The printed decorative surface covering according to claim 1, wherein the thickness of the primer layer is comprised between 5 and 20 μm.

23. The method of claim 6 wherein the printing is by way of digital printing.

24. The method according to claim 7 wherein the acrylic copolymer dispersion comprises an anionic acrylic copolymer dispersion comprising silica, said Minimum Film Forming Temperature, according to ASTM D2354, comprised between 15 and 50° C.

25. The printed decorative surface covering according to claim 1, wherein a dioctyl adipate absorption capacity of the silica comprises between 200 and 300 ml per 100 g of silica.

26. The printed decorative surface covering according to claim 1, wherein the primer layer comprises from 1 to 10% by weight of dispersing and antifoaming additives.

* * * * *